United States Patent [19]

Shaub et al.

[11] 4,283,940

[45] Aug. 18, 1981

[54] METHOD FOR DECONDITIONING AN ENGINE USED IN FUEL ECONOMY TESTS

[75] Inventors: Harold Shaub, New Providence; Joseph M. Pecoraro, Red Bank, both of N.J.

[73] Assignee: Exxon Research & Engineering Co., Florham Park, N.J.

[21] Appl. No.: 109,230

[22] Filed: Jan. 3, 1980

[51] Int. Cl.[3] ..... G01M 15/00

[52] U.S. Cl. ..... 73/116; 73/10

[58] Field of Search ..... 73/116, 114, 10, 64

[56] References Cited

U.S. PATENT DOCUMENTS

| | | | |
|---|---|---|---|
| 3,562,159 | 2/1971 | Mastin | 252/32.7 |
| 3,671,430 | 6/1972 | Corringer | 252/32.7 E |

OTHER PUBLICATIONS

Smalheer, C. V. et al., Lubricant Additives, 1967, pp. 2–6, Publication by The Lezius-Hiles Co., Cleveland, Ohio Waddey, W. E. et al., Improving Fuel Economy Via Engine Oils, Paper 780,599 SAE Passenger Car Meeting, Jun. 1978.

Retzloff, J. B. et al., Fuel Economy Benefits from Modified Crankcase Lubricants, ASLE Preprint No. 79-A-M-2C-1, Apr.-May 1979.

Haviland, M. L. et al., Fuel Economy Improvements . . . Road Tests, SAE Paper 790,945, Oct. 1979.

*Primary Examiner*—Jerry W. Myracle

*Attorney, Agent, or Firm*—Eugene Zagarella, Jr.

[57] ABSTRACT

A method for deconditioning an engine used in evaluating the fuel economy derived from lubricating oils wherein a deconditioning oil is added to the engine after removal of the test lubricating oil, the deconditioning oil comprising a lubricating oil composition containing a selected overbased metal salt or a selected neutral metal salt, the salt being selected from the group consisting of alkali metal or alkaline earth metal sulfonates, phenates, phosphonates and thiophosphonates.

14 Claims, No Drawings

METHOD FOR DECONDITIONING AN ENGINE USED IN FUEL ECONOMY TESTS

BACKGROUND OF THE INVENTION

This invention relates to an improved method for determining the fuel economy which results from the use of fuel efficient carry-over lubricating oils in internal combustion engines. More particularly, this invention involves a method for deconditioning engines used in determining the fuel economy benefits of fuel efficient or friction reducing engine oils wherein a deconditioning oil comprising selected overbased metal salt materials or neutral/normal metal salts in selected amounts is exposed to said engine for a period of time after a candidate oil is tested therein.

In recent years there has been considerable effort to reduce the fuel consumption of internal combustion engines, particularly automotive engines. This has primarily resulted because of the declining sources of petroleum, the rapid escalation in fuel prices and the increasing awareness of energy conservation needs. Many engineering changes have been made to improve fuel economy including more efficient engine systems and car weight reduction through downsizing and expanded use of lightweight materials. While these changes have produced substantial improvements in vehicular fuel economy, additional improvements from other practical sources are still necessary and desirable.

One approach to fuel economy which has recently received considerable attention is the use of lubricants and particularly motor oils which improve fuel economy by reducing the overall friction in the engine and thus result in a reduction of energy requirements. Such so-called "fuel economy" engine oils generally contain friction-reducing or friction-modifying additives.

Along with the introduction of the fuel economy oils came the need for measuring the performance of such oils to determine the actual savings or benefit. This is of particular importance to various industry and government parties interested in assessing or evaluating different types of fuel economy engine oils. Techniques are known for measuring the fuel economy effects of different lubricant oils and generally they involve a comparison of the results obtained with a test oil and a reference oil. While such a procedure may at first seem like a straightforward test operation, it is not that simple since even relatively small variations in some operating conditions can affect the apparent results and thereby obscure the true fuel economy benefits of a test oil.

One problem which has significantly affected the measurement of fuel efficiency for lubricating oils and particularly those containing boundary friction additives is the so-called "carry-over" effect. The carry-over fuel economy effect is defined as an effect characteristic of fuel efficient engine oils whereby these oils condition the engine to produce higher fuel economy which persists for an extended period of operation after the fuel efficient oil has been replaced with a non-fuel efficient oil. In other words it is the residual fuel economy effect imparted by certain lubricating oils. The problem created by the carry-over effect is that it becomes difficult and time consuming to bring a test engine back to a stabilized reference point. However, this is essential if there is to be a meaningful evaluation of different oils.

Accordingly there is the need for a procedure for evaluating the fuel economy effects of lubricating oils in a reasonably quick, efficient manner and particularly overcomes the problem of carry-over which is created by certain oils.

SUMMARY OF THE INVENTION

Now it has been found that the fuel economy benefits of lubricating oils can be measured more effectively and quickly in accordance with the method of this invention wherein the test engine is deconditioned using a deconditioning oil containing selected overbased metal salt materials or alternatively selected neutral metal salts after a candidate lubricating oil is evaluated in said engine. More particularly, this invention involves a method wherein a test engine is deconditioned using a deconditioning oil which contains an overbased alkali metal or alkaline earth metal detergent selected from the group consisting of overbased sulfonates, phenates and phosphonates and/or thiophosphonates in an amount sufficient to give the deconditioning oil a total base number (TBN) of about 15 to about 100 or alternatively the neutral alkali or alkaline earth metal salt of said sulfonates, phenates, phosphonates and/or thiophosphonates in an amount of at least 5 percent by weight.

DETAILED DESCRIPTION OF THE INVENTION

This invention involves an improved method for determining the fuel economy derived from lubricating oils used in internal combustion engines and more particularly involves the deconditioning of the test engine used in the evaluation of such oils.

The essence of this invention involves the deconditioning of a test engine after it has been used in evaluating a candidate lubricating oil to bring the engine back to its starting or stabilized reference point. The deconditioning of the engine involves removal of the test oil from the engine and adding selected deconditioning oil for a sufficient time to effectively bring the engine back to the reference or base point as measured by fuel efficiency.

An important feature of this invention is the particular deconditioning oil that is used. This deconditioning oil will generally comprise a lubricating oil composition containing a selected overbased metal salt material or a selected neutral metal salt. The overbased metal material will generally be an alkali or alkaline earth metal salt selected from the group consisting of overbased sulfonates, phenates, phosphonates and thiophosphonates and the neutral metal salts will be alkali or alkaline earth metal salts of the sulfonates, phenates, phosphonates and thiophosphonates.

The overbased and neutral metal materials used in this invention are generally well known in the art. See for example, U.S. Pat. Nos. 3,562,159 and 3,671,430 and "Lubricant Additives" by C. V. Smalheer and R. Kennedy Smith, pp. 2–6, 1967. The sulfonates are obtained by sulfonating either natural or synthetic hydrocarbons. Natural hydrocarbons that are used are generally petroleum fractions, most usually lubricating oil distillate fractions, or the so-called white oil distillate, or other fractions such as petrolatum. These are converted to sulfonic acids by treatment with suitable sulfonating agents, including sulfur trioxide, concentrated sulfuric acid and fuming sulfuric acid. Synthetic hydrocarbon sulfonic acids are usually prepared by sulfonating alkylated aromatic hydrocarbons, e.g. benzene, toluene, xylene or naphthalene, that have been alkylated with wax hydrocarbons, olefins, olefin polymers, or similar sources of alkyl groups. Typically, benzene or toluene is alkylated with a polymer of propylene or of butylene, e.g. butylene trimer or propylene tetramer or similar low olefin polymer, and the alkylate is sulfonated.

The preparation of overbased sulfonates is well known in the art and simply stated the sulfonic acids are reacted with an excess of metal base and the excess metal is then usually neutralized with an acidic gas, most usually carbon dioxide. See U.S. Pat. No. 3,671,430.

The phenate materials which are used are the metal salts of alkylphenols, alkylphenol sulfides and alkylphenolaldehyde condensation products. The preparation of the phenate materials is well known and preparation of the overbased metals of these materials is similar to that of the sulfonates and is also well known. One procedure for preparing a sulfurized metal alkyl phenate is to react elemental sulfur with the metal alkyl phenate at an elevated temperature. The metal salt can be overbased before sulfurizing, after sulfurizing or at the same time. See, for example, U.S. Pat. No. 3,966,621.

The phosphonates or thiophosphonate materials are generally the metal salts of the phosphonic or thiophosphonic acids obtained from the reaction of polyolefins, such as polyisobutenes with inorganic phosphorus reagents such as phosphorus pentasulfide. The preparation of the overbased metals of these materials is similar to that of the sulfonates and phenates described above.

The sulfonic acids whose overbased metal salts are employed in the present invention will generally have molecular weights within the range of about 300 to about 1200, more usually within the range of about 400 to about 800. The alkyl phenols whose overbased metal salts are employed in this invention will generally have alkyl groups with a total of about 4 to about 24 carbon atoms, or more usually from about 8 to about 18 carbon atoms, e.g., diisobutyl phenol, nonyl phenol, dinonyl phenol or dodecyl phenol. The polyolefins used in preparing the phosphonate or thiophosphonate materials will generally have a molecular weight of about 500 to about 2000.

The overbased metal materials as described above are generally prepared in the form of oil concentrates having a total base number (TBN) of from about 100 to about 500, preferably from about 200 to about 400 (ASTM-D-664) and containing about 30 to 75 wt.% of active ingredient.

Other overbased metal detergent salts that can be used in this invention include overbased complexes prepared by reaction of phosphosulfurized polymeric hydrocarbons with alkaline earth metal bases in the presence of an alkyl phenol or alkyl phenol sulfide and then treating the product with carbon dioxide. See e.g. U.S. Pat. Nos. 3,182,019 and 3,127,348. Related overbased dispersions where the colloidally dispersed metal salt is a sulfate or phosphate in place of or in addition to the carbonate can also be used. See U.S. Pat. No. 3,644,106.

The metal used will generally be an alkali metal or alkaline earth metal. More particularly the alkali metal will be lithium, sodium, potassium or cesium and the alkaline earth metals will be magnesium, calcium, barium, or strontium. Preferably the metal will be magnesium or calcium with magnesium being most preferred.

The amount of overbased metal or neutral metal detergent used in the deconditioning oil of this invention is not in itself critical and will generally be an amount which will effectively return the fuel economy of the test engine back to its original reference or base point in a fairly quick time period and not physically cause any damage to the engine. More particularly, the amount of overbased metal material will be sufficient to give the deconditioning oil composition as a whole, a total base number (TBN) of about 15 to about 100, preferably about 15 to about 50 and more preferably about 20 to about 40. Generally, a concentration of overbased metal of about 5% by weight or more will be sufficient to give the deconditioning oil such a TBN. When the neutral metal material is used, the amount of such material will generally be at least 5% by weight. More particularly the amount of neutral metal material used will be from about 5 to about 25% by weight, preferably about 10 to about 20%.

The deconditioning oil, in addition to the overbased or neutral metal material, as defined above will generally comprise a lubricating oil composition and more particularly an automotive engine lubricating oil. Such lubricating oils are, of course, well known and include as the base component the mineral lubricating oils and mixtures thereof. The base component can also be a synthetic oil, e.g. diester oils such as di(2-ethylhexyl) sebacate, azelate and adipate; complex ester oils such as those formed from dicarboxylic acids, glycols and either monobasic acids or monohydric alcohols; silicone oils, sulfide esters, organic carbonates, and other synthetic oils known in the art.

Other additives, many of which are conventional, in the lubricating oil art may be included in this deconditioning oil. Such additives include oxidation inhibitors such as phenothiazine or phenyl $\alpha$-naphthylamine; rust inhibitors such as lecithin or sorbitan monoleate; an antiwear agent such as zinc dihydrocarbyl dithiophosphate; pour point depressants such as copolymers of vinyl acetate with fumaric acid esters of coconut oil alcohols; and viscosity index improvers such as olefin copolymers, polymethacrylates, etc.

As indicated above, the essence of this invention involves a method of deconditioning a test engine wherein the engine after being exposed under fired operating conditions to a test or candidate oil, is exposed under fired operating conditions to a deconditioning oil containing the selected overbased metal or neutral metal materials described above. The purpose of this latter step is to bring the engine back to its original base or reference point with respect to fuel economy in a reasonably quick time period. The importance of this is more readily realized when the nature of fuel economy measurements is considered in some detail. Since fuel economy effects due to lubricants are generally small and can amount to as little as a few tenths of a mile per gallon, great care must be exercised in testing in order to detect such small differences. Standardized tests such as the EPA city and highway tests, i.e. the 1975 Federal Test Procedure (FTP) and Highway Fuel Economy Test (HFET) are known and used. These tests are further described in "Fuel Economy Benefits from Modified Crankcase Lubricants" by J. B. Retzloff et al, ASLE Preprint No. 79-AM-2C-1, April-May 1979 and "Improved Fuel Economy Via Engine Oils" by W. E. Waddey, H. Shaub and J. M. Pecoraro, Paper 780599 presented at SAE Passenger Car Meeting, June, 1978. Combined fuel economy is a weighted harmonic mean of the city (55%) and highway (45%) values and is called or identified as the EPA 55/45 test. This test is described in "Fuel Economy Improvements with Friction-Modified Engine Oils in Environmental Protection Agency and Road Tests" by M. L. Haviland et al in SAE Paper 790945, October, 1979, and the above identified Waddey et al SAE paper. While such standardized tests help in obtaining fairly reliable fuel economy measurements for evaluation and comparison purposes, nevertheless there are other conditions or factors which can affect the results. One such condition is that different vehicles can and usually do give different results. Therefore, in making a comparative evaluation, it is generally necessary to use the same vehicle. In using the same vehicle from one test to the next, it is important that the same base or reference starting point is used. To reach the same base or reference point, it is necessary to flush out or clean the engine between tests so that the effects of one test oil do not carry-over into the next test. Oftentimes this can be accomplished by running the engine for a period of time after the test oil has been replaced with a conventional and standard reference oil. In many cases, however, it takes a rather long period of time or several thousand miles before the reference point of the engine can be re-established. This is particularly true when a fuel-efficient oil containing a boundary friction reducing additive is used and there is a carry-over effect as previously described. By using the deconditioning oil of this invention, the reference point of a test engine can be re-established in a relatively short time, particularly when the test oil contains friction reducing additives.

Generally, the reference point of the test engine can be re-established when the deconditioning oil is placed in the test engine under fired conditions and operating at a cycle of from about 250 to about 3000 miles or about 1 to about 200 hours at fired idle conditions. More particularly, the deconditioning oil will be maintained in the test engine for about 1000 to about 1500 miles with the engine in a fired operating cycle or at about 10 to about 100 hours at fired idle conditions. The operating cycle is generally performed under typical city-suburban conditions.

In carrying out the method of this invention, the engine is generally stabilized with a reference oil, that is, a conventional lubricating oil such as an automotive engine oil for a short period of, for example, 500 to 2000 miles of engine operation. The test oil is then placed in the engine which is operated for a significant period of time, usually at least about 2000 miles and following this, the test oil is replaced with deconditioning oil for a period as previously defined. Generally, this will be sufficient to bring the engine back to its original starting reference point. It has been observed that particularly good results are obtained when the reference oil is again placed in the test engine after the deconditioning oil, for a short period of about 500 miles. This method has proven to be particularly effective in re-establishing the reference point to essentially the same starting point and significantly, this was obtained in a very short time period even when oils containing friction reducing additives were being tested.

The method of this invention as described above is useful when the test oil is any lubricating oil and particularly a fuel economy lubricating oil having a carry-over effect. The method is especially useful when the test oil is a fuel economy lubricating oil such as an automotive engine oil which contains a boundary friction-reducing additive. This invention is therefore particularly useful when the lubricating oils being tested contain a friction reducing additive such as graphite dispersions, molybdenum disulfide dispersions, esters of polycarboxylic acid with a glycol, soluble molybdenum compounds, amine salts of dialkyldithiophosphate, amine salts such as octadecylamine; dioleyl phosphate and sperm oils.

The particularly preferred deconditioning oil is one wherein the deconditioning oil contains an overbased metal salt and more particularly the magnesium or calcium overbased metal salts.

The method of this invention can be carried out in any engine and more particularly an internal combustion engine such as automotive, aircraft and diesel engines.

The following examples are further illustrative of this invention and are not to be construed as limitations thereof.

EXAMPLE 1

Fuel economy tests, i.e. a city cycle following the 1975 Federal Test Procedure (FTP) and a highway cycle following the Highway Fuel Economy Test (HFET), both previously described, were run for a test oil and the combined fuel economy determined, i.e. the EPA 55/45 test also previously described, on each of two different automobiles defined below.

The actual test involved operating each vehicle, which had initially been broken in and having a stabilized fuel economy, while it contained a reference oil for 2000 miles. Test measurements were then taken for the different fuel economy tests to establish the starting reference points. The reference oil was a conventional 10W-40SE quality automotive engine oil containing a base oil, a dispersant, a zinc dialkyl dithiophosphate antiwear additive, a V.I. improver, an ashless oxidation inhibitor, and a small amount (<2.0%) of an overbased metal detergent which included an overbased magnesium hydrocarbyl sulfonate component.

Following the determination of the reference points, the reference oil was replaced with a test fuel economy oil and the engine operated for 2000 miles. The different fuel economy test measurements were again measured. The test oil was a 10W-40SE quality fuel economy automotive engine oil which contained a friction reducing additive. The test oil contained a base oil, an ester formed by esterification of a dimer acid of linoleic acid and diethylene glycol as the friction reducing additive, a dispersant, a zinc dialkyl dithiophosphate antiwear additive, a V.I. improver, an oxidation inhibitor and a small amount (<2.0%) of an overbased metal detergent which included an overbased magnesium hydrocarbyl sulfonate component.

Subsequently, the candidate oil was replaced in each engine by a deconditioning oil and the engine operated for 1500 miles. The deconditioning oil was an oil very similar to the reference oil but additionally contained 10% by weight of an overbased magnesium hydrocarbyl sulfonate concentrate (about 40 wt.% of active ingredient) of about 300 total base number (TBN) to give the deconditioning oil a TBN of about 30–40.

Following the engine operation with the deconditioning oil as described above, such deconditioning oil was replaced with the same reference oil as identified previously and the engine operated for another 500 miles. Test measurements were made on each of the two engines and the results are given below:

| Car Number 1, 1978 Ford Pinto (2.3L, L-4) | FTP (MPG) | HFET (MPG) | 55/45 (MPG) |
|---|---|---|---|
| After Reference Oil | 19.161 | 26.927 | 22.019 |
| After Test Oil | 19.966 | 28.088 | 22.953 |
| After Deconditioning Oil + Reference Oil | 19.201 | 26.717 | 21.984 |
| 95% Confidence Interval | ±0.126 | ±0.101 | ±0.093 |

| Car Number 2, 1978 Plymouth Volare (3.7L, S6) | FTP (MPG) | HFET (MPG) | 55/45 (MPG) |
|---|---|---|---|
| After Reference Oil | 16.273 | 24.533 | 19.178 |
| After Test Oil | 16.487 | 25.782 | 19.680 |
| After Deconditioning Oil + Reference Oil | 16.342 | 24.154 | 19.164 |
| 95% Confidence Interval | ±0.067 | ±0.0699 | ±0.054 |

The results with reference oil were an average of four runs, with test oil an average of eight runs and with deconditioning oil and reference oil an average of four runs.

EXAMPLE 2

A similar procedure as in Example 1 was performed using three different engines and a test oil which was essentially the same and contained the same components including a friction reducing ester type additive but a different V.I. improver and dispersant.

Test measurements were made on each of the three engines and the results are given below:

| Car Number 1 - 1976 Buick Century (3.8L, V6) | FTP (MPG) | HFET (MPG) | 55/45 (MPG) |
|---|---|---|---|
| After Reference Oil | 15.281 | 22.093 | 17.706 |
| After Test Oil | 15.933 | 23.120 | 18.524 |
| After Deconditioning Oil + Reference Oil | 15.290 | 21.726 | 17.642 |
| 95% Confidence Interval | ±0.088 | ±0.1554 | ±0.0819 |

| Car Number 2 - 1978 Nova (4.1L, L6) Chevrolet | FTP (MPG) | HFET (MPG) | 55/45 (MPG) |
|---|---|---|---|
| After Reference Oil | 16.286 | 23.553 | 18.912 |
| After Test Oil | 16.670 | 24.393 | 19.440 |
| After Deconditioning Oil + Reference Oil | 16.243 | 23.549 | 18.879 |
| 95% Confidence Interval | ±0.014 | ±0.078 | ±0.045 |

| Car Number 3 - 1978 Pontiac Bonneville (5.7L, V8) | FTP (MPG) | HFET (MPG) | 55/45 (MPG) |
|---|---|---|---|
| After Reference Oil | 15.362 | 22.608 | 17.951 |
| After Test Oil | 15.870 | 24.127 | 18.759 |
| After Deconditioning Oil + Reference Oil | 15.331 | 22.551 | 17.912 |
| 95% Confidence Interval | ±0.174 | ±0.046 | ±0.128 |

The results with reference oil were an average of four runs, with test oil an average of eight, six and five runs, respectively, and the results with deconditioning oil and reference oil were an average of four runs.

EXAMPLE 3

Fuel economy tests as in Example 1 were run on a test 10W-40SE automotive engine oil in each of six different automobiles defined below. The test procedure was different in that the final fuel economy measurements were made after the reference oil replaced the deconditioning oil but with zero mileage on the reference oil (not 500 miles as in Example 1).

The test oil was very similar to the test oil of Example 1 and contained the same friction reducing ester type additive and a different anti-wear additive. Results are given below:

| Car Number 1 - 1975 Ford Grand Torino (5.7L, V8) | FTP (MPG) | HFET (MPG) | 55/45 (MPG) |
|---|---|---|---|
| After Reference Oil (Ave. 2 Runs) | 9,84 | 15.66 | 11.811 |
| After Test Oil | 10.16 | 16.70 | 12.345 |
| After Deconditioning Oil + Reference Oil (No mileage) | 9.62 | 15.21 | 11.522 |
| 95% Confidece Interval | ±0.381 | ±0.259 | ±0.2753 |

| Car Number 2 - 1975 Chevrolet Malibu (5.7L, V8) | FTP (MPG) | HFET (MPG) | 55/45 (MPG) |
|---|---|---|---|
| After Reference Oil | 11.12 | 17.06 | 13.185 |
| After Test Oil | 11.09 | 17.89 | 13.378 |
| After Deconditioning Oil + Reference Oil (No mileage) | 11.08 | 16.85 | 13.094 |
| 95% Confidence Interval | ±0.206 | ±0.145 | ±0.1838 |

| Car Number 3 - 1976 Pontiac Lemans (5.7L, V8) | FTP (MPG) | HFET (MPG) | 55/45 (MPG) |
|---|---|---|---|
| After Reference Oil | 13.34 | 19.75 | 15.623 |
| After Test Oil (Ave. 2 Runs) | 13.42 | 20.63 | 15.920 |
| Deconditioning Oil + Reference Oil (No Mileage) | 13.39 | 19.71 | 15.649 |
| 95% Confidence Interval | ±0.235 | ±0.124 | ±0.2022 |

| Car Number 4 - 1976 Chevrolet Vega (2.3L, L4) | FTP (MPG) | HFET (MPG) | 55/45 (MPG) |
|---|---|---|---|
| After Reference Oil | 18.61 | 28.88 | 22.156 |
| After Test Oil | 18.60 | 31.04 | 22.695 |
| After Deconditioning Oil + Reference Oil (No Mileage) | 17.97 | 28.94 | 21.645 |
| 95% Confidence Interval | ±0.074 | ±0.204 | ±0.0567 |

| Car Nuber 5 - 1976 Ford LTD Wagon (6.6L, 8) | FTP (MPG) | HFET (MPG) | 55/45 (MPG) |
|---|---|---|---|
| After Reference Oil | 11.37 | 16.93 | 13.338 |
| After Test Oil | 11.70 | 18.25 | 13.959 |
| After Deconditioning Oil + Reference Oil (No Mileage) | 11.26 | 16.91 | 13.252 |
| 95% Confidence Interval | ±0.183 | ±0.256 | ±0.1508 |

| Car Number 6 - 1976 Plymouth Volare (4.1L, 6) | FTP (MPG) | HFET (MPG) | 55/45 (MPG) |
|---|---|---|---|
| After Reference Oil | 17.36 | 25.66 | 20.312 |
| After Test Oil | 17.24 | 26.54 | 20.469 |
| After Deconditioning Oil + Reference Oil (Mo Mileage) | 16.93 | 25.85 | 20.037 |
| 95% Confidence Interval | ±0.450 | ±0.329 | ±0.4160 |

All of the results for the above 6 cars are an average of three runs except as noted.

EXAMPLE 4

For comparison purposes, the fuel economy of a 10W-40SE quality economy automotive engine test oil similar to the ones in Examples 1 and 2 and containing the same friction reducing ester type additive was compared with the fuel economy measurements of the same engine after it was replaced with a reference oil, i.e. without the deconditioning oil added. Results showed that after 3000 miles with the reference oil, where was still a significant carry-over effect wherein the fuel economy was over 2% greater than the base reference point.

The above examples all indicate the advantage of using the deconditioning oil in the method of this invention wherein the base reference point was essentially re-established in a relatively short period of time.

What is claimed is:

1. A method for deconditioning an engine used in fuel economy tests for a lubricating oil comprising replacing a test lubricating oil after it is tested in said engine with a deconditioning oil composition comprising a lubricating base oil containing an overbased alkali or alkaline earth metal compound selected from the group consisting of sulfonates, phenates, phosphonates and thiophosphonates in an amount sufficient to give the deconditioning oil a total base number of about 15 to about 100 or a neutral alkali or alkaline earth metal compound selected from the group consisting of sulfonates, phenates, phosphonates and thiophosphonates in an amount of at least 5% by weight.

2. The method of claim 1 wherein the deconditioning oil is left in said engine under fired operating conditions for an operating cycle of about 250 to about 3000 miles or at fired idle conditions for about 1 to about 200 hours.

3. The method of claim 2 wherein the alkali or alkaline earth metal is selected from the group consisting of magnesium, calcium, barium, strontium, lithium, sodium, potassium or cesium.

4. The method of claim 1 wherein the alkali or alkaline earth metal compound contained in said deconditioning oil is the overbased alkali or alkaline earth metal compound and in an amount sufficient to give the deconditioning oil a total base number of about 15 to about 50.

5. The method of claim 4 wherein the deconditioning oil is left in said engine under fired operating conditions for an operating cycle of about 250 to about 3000 miles or at fired idle conditions for about 1 to about 200 hours.

6. The method of claim 5 wherein the alkali or alkaline earth metal compound is selected from the group consisting of magnesium, calcium, barium, strontium, lithium, sodium, potassium and cesium.

7. The method of claim 6 wherein the test lubricating oil is a fuel economy carry-over oil containing a friction reducing additive.

8. The method of claim 7 wherein the overbased metal compound is calcium or magnesium.

9. The method of claim 8 wherein the deconditioning oil has a total base number of about 20 to about 40.

10. In the method for measuring the fuel economy of an engine lubricated with a lubricating oil wherein the fuel economy of a test lubricating oil is compared with the fuel economy of a reference oil, the improvement wherein the engine is deconditioned after being exposed to the test lubricating oil with a deconditioning oil comprising a lubricating base oil containing an overbased alkali or alkaline earth metal compound selected from the group consisting of sulfonates, phenates, phosphonates and thiophosphonates in an amount sufficient to give the deconditioning oil a total base number of about 15 to about 100.

11. The method of claim 10 wherein the test lubricating oil is a fuel economy carry-over lubricating oil containing a friction reducing additive.

12. The method of claim 11 wherein the deconditioning oil is left in said engine under fired operating conditions for an operating cycle of about 250 to about 3000 miles or at fired idle conditions for about 1 to about 200 hours.

13. The method of claim 12 wherein the overbased metal compound is magnesium or calcium and is used in an amount to give the deconditioning oil a total base number of about 15 to about 50.

14. The method of claim 13 wherein the deconditioning oil is left in said engine under fired operating conditions for an operating cycle of about 250 to about 3000 miles or at fired idle conditions for about 10 to about 100 hours and the reference oil is added to said engine after the deconditioning oil is removed for a short period of time to effectively re-establish the reference fuel economy starting point of the engine.

* * * * *